United States Patent [19]

Lundström

[11] 4,028,051

[45] June 7, 1977

[54] CURING OVEN FOR MINERAL WOOL

[75] Inventor: Bengt Lundström, Torslanda, Sweden

[73] Assignee: Jungers Verkstads AB of Goteborg, Sweden

[22] Filed: Sept. 5, 1975

[21] Appl. No.: 610,854

[30] Foreign Application Priority Data

Sept. 27, 1974 Sweden ..... 7412167

[52] U.S. Cl. ..... 432/144; 34/216; 34/236

[51] Int. Cl.[2] ..... F27B 9/00; F26B 25/00

[58] Field of Search ..... 432/123, 137, 144, 145; 34/191, 216, 217, 236

[56] References Cited

UNITED STATES PATENTS

| | | | |
|---|---|---|---|
| 2,732,631 | 1/1956 | Black | 34/236 X |
| 3,069,786 | 12/1962 | Nichols, Jr. | 34/216 X |
| 3,089,254 | 5/1963 | Johnson et al. | 34/236 X |
| 3,281,958 | 11/1966 | Lambert et al. | 34/216 X |
| 3,374,106 | 3/1968 | Thygeson, Sr. | 34/216 X |
| 3,738,020 | 6/1973 | Hanton | 34/217 |

*Primary Examiner*—John J. Camby

[57] ABSTRACT

A curing oven for impregnated mineral wool in the shape of mats comprises a pair of endless cooperating conveyors facing each other and being arranged in a housing, and on either side of the cooperating parts of conveyors several pressure — and evacuation chambers are located for feeding hot air through the mat. The pressure — and evacuation chambers are arranged in such a way that the air can be brought in mutually reverse directions through the mat, and they are designed with a decreasing cross sectional area in the direction away from the induction — and evacuation ports. The interior spaces of the housing located outside the pressure — and evacuation chambers are kept at a lower pressure than the ambient pressure by a pump unit.

6 Claims, 4 Drawing Figures

CURING OVEN FOR MINERAL WOOL

BACKGROUND OF THE INVENTION

The present invention relates to a curing oven for mineral wool, especially rock wool or glass wool, comprising a pair of endless conveyors for feeding impregnated mineral wool in the shape of mats of appropriate thickness through the oven, which pair of conveyors are arranged in a housing and facing each other for cooperation, whereby the oven comprises pressure — and evacuation chambers arranged on either side of the cooperating parts of the conveyors and intended for feeding heated medium through the mat.

Mineral wool is extensively used for insulation purposes and for this purpose the mineral wool is often offered for sale in the shape of mats. The manufacture of such mats is mainly accomplished in such a way that the initial erase material is spun and then together with a binding agent is introduced into a conveyor which exerts a certain pressure on the material to cause it attain the desired thickness and the intended density. A curing of the material impregnated with the binding agent must however be effected; this curing has previously been accomplished by feeding hot air to the material when situated on the conveyor. The hot air has sometimes been fed through a pair of so called "air boxes" located on both sides of the conveyor. It, however, has proved that the curing will not be sufficiently uniform, and depending on, that the air used for curing purposes has a relatively high temperature, of the rating 200°–300° C, problems with heat leakage has arisen and a considerable increase of the ambient temperature has thereby been caused. The high temperature of the air easily causes an overcuring on the upper side of the mat, whereas as insufficient curing is obtained on the underside of the mat.

SUMMARY OF THE INVENTION

One object of the invention is therefore to provide a curing oven which removes the problem with non-uniform curing of the material. Another object of the invention is to provide a curing oven in which the heat leakage problems to a great extent have been eliminated in that the hot air flows through the material has been limited to a principally closed room and by keeping the spaces outside the areas for hot air feed and evacuation at a pressure lower than the ambient pressure of the oven.

Since the hot part of the oven is well delimited, the drives of the conveyor can be mounted in an area of relatively moderate temperature, whereby less wear and fewer shutdowns will occur.

In order to remove the former mentioned curing problem, particular air distribution devices or pressure — and evacuation chambers designed with a decreasing cross-sectional area in the direction away from the induction — and evacuation ports are used and with that essentially the same pressure distribution and air speed are achieved through the whole mineral wool mat. The curing oven is preferably built in several sections, each being provided with an appropriate number of air distribution devices, and these devices should be governed so that the hot air through the mat is brought in alternate directions from section to section or from air distribution device to air distribution device.

DESCRIPTION OF A PREFERRED EMBODIMENT

Figure 1:
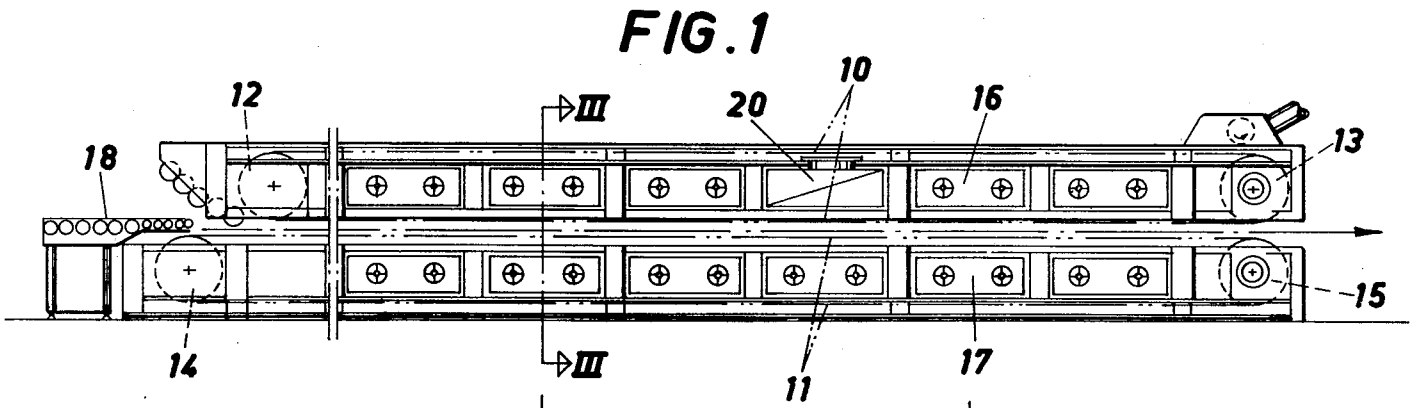
FIG. 1 is a broken schematic side elevation showing one section of the curing oven according to the invention with the infeed end of the oven and its outfeed end which is shown as a termination of the section.

Two endless conveyors are marked with the numbers 10 and 11 in FIG. 1. These conveyors are led over driving cyclinders 12, 13 and 14, 15 located outisde the curing oven. On either side of the parts of the conveyors 10 and 11 facing each other several air distribution boxes or pressure — and evacuation chambers are located. The boxes are identical and will be described more in detail in connection with FIG. 3. Inspection covers leading to the cold part of the oven are marked with numbers 16 and 17 in FIG. 1. In FIG. 1 there is also schematically shown a putting-up table 18 for spun mineral wool material soaked with an impregnating agent. This material is introduced between the conveyors 10 and 11 and is fed past the different distribution boxes to the outfeed end at the cylinders 13, 15. These cylinders are together with the distribution boxes supported by the frame 47 of the curing oven. The frame is so designed that the upper conveyor 10 can be adjusted vertically relative to the lower conveyor 11. For this purpose an appropriate transmission device can be arranged in connection to the driving motor of the conveyors, for instance to make possible that several adjustment screws simultaneously shall be effected and provide the required height adjustment. The height adjustment device for the upper conveyor has not been shown in detail, but in FIG. 3 there is shown by means of a broken line and a double arrow that a height adjustment is foreseen.

Such a height adjustment is in most cases necessary, while there are different applications for different demands for the condition of the finished mineral wool material.

The oven, which comprises several sections and is supported by said frame construction 47, is completely encased and insulated.

Figure 2:
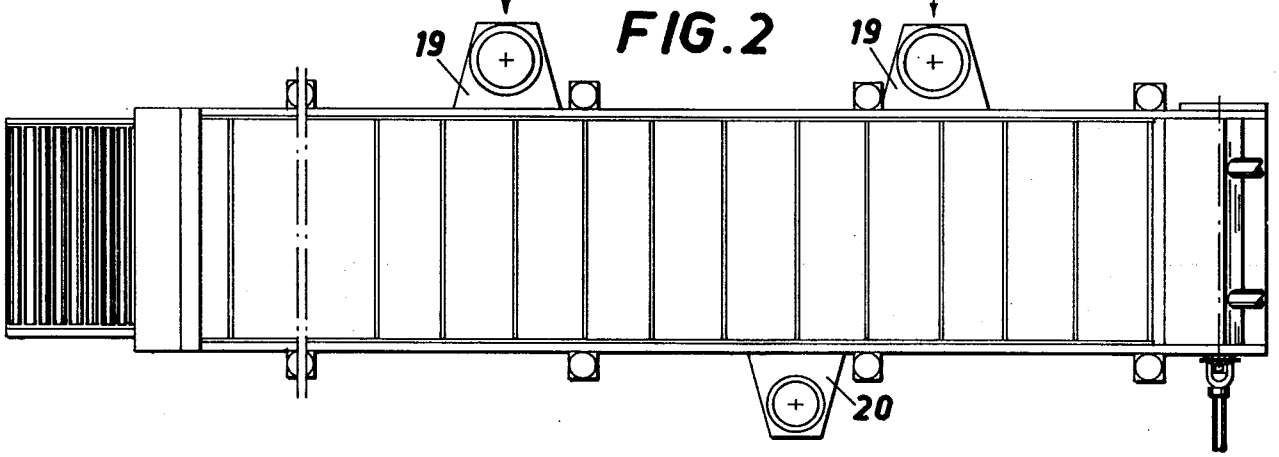
FIG. 2 is a view from above of the curing oven and shows the connection boxes for the air distribution devices which connection boxes being part of one section, the figure further shows a connection for attaining a negative pressure outside said distribution devices.

In FIGS. 1 and 2 there is shown the end section of the oven with the outfeed part and the infeed part of the oven is also shown. The oven can e.g. comprise three sections, but any appropriate number of sections can of course be used. Two connection boxes 19 for fan and pump units are arranged for each section, and additionally there is one more connection box 20 for each section. The latter connection box is connected to a pump (eracuation) unit for providing a negative pressure relative to the environment in that space of the interior of the oven which is located outside the areas defined by the air distribution devices or the blowing boxes.

Figure 3:
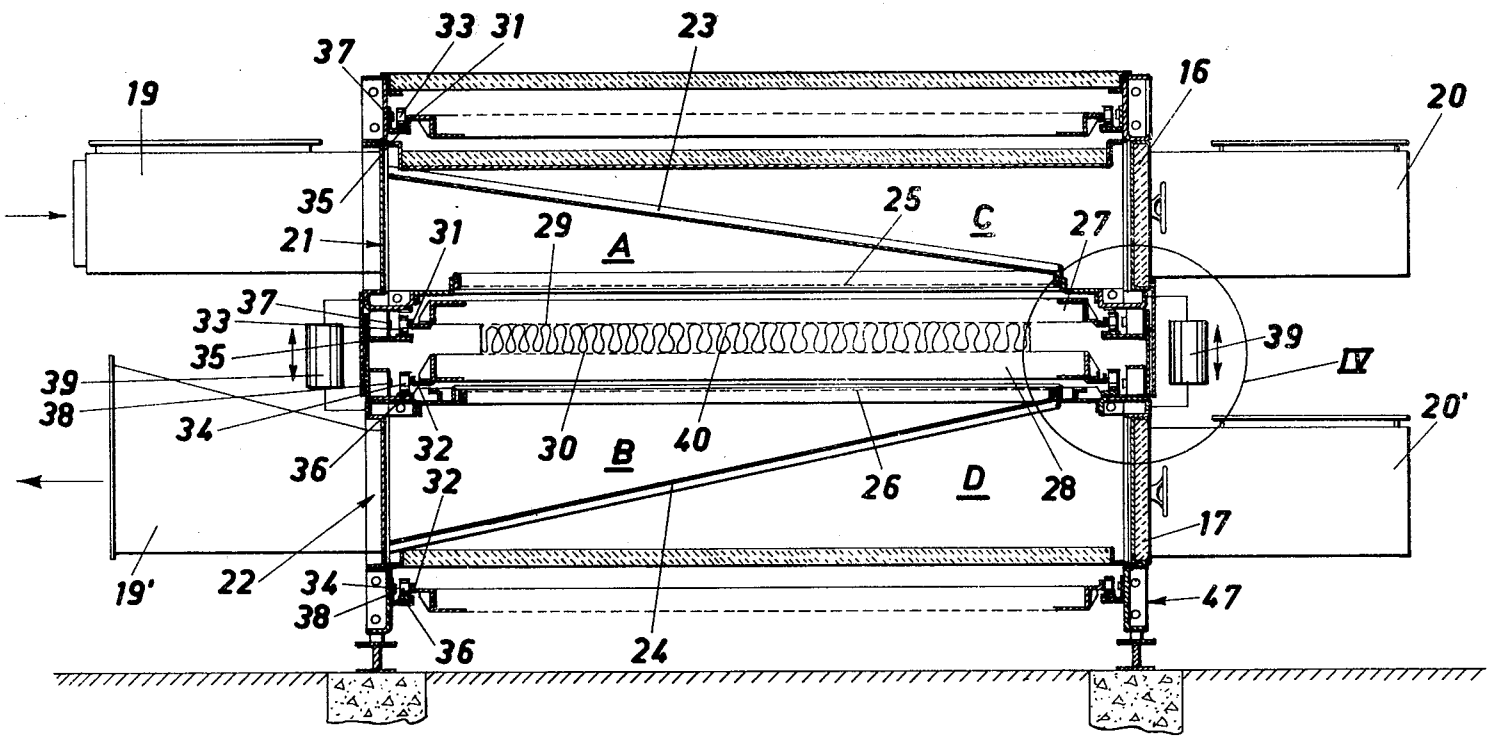
FIG. 3 is an inlarged cross section taken along the line III — III in FIG. 1, and shows i.a. the air distribution devices.

The inspection covers shown in FIGS. 1 and 3 lead to said spaces C, D. As is evident from FIG. 3, the air distribution devices — or boxes or the pressure — and evacuation chambers A and B supported by the frame are defined by plates 23 and 24 extending obliquely downwards from the upper edge of induction ports 21 and upwards from the lower edge of evacuation ports 22, resp. The bottoms of the distribution boxes are defined by perforated plates 25, and the upper portions of the boxes are correspondingly terminated by perforated plates 26. In the longitudinal direction of the oven, the boxes are defined by side plates (not shown), and the length of the boxes is chosen e.g. so that the boxes directly connect to each other, or so that appropriate spaces are obtained. The plates 25 and 26 face the interior of conveyors 10 and 11, resp. at cooperating parts of the conveyors. The coneyors are build up in sections comprising canted iron supports 27 and 28. Two adjacent iron supports should be covered by plane, perforated plates 29, 30, so that a plane surface always is obtained along the portions of the conveyors facing each other. These conveyors 10, 11 consisting of iron supports and plates are impelled by chains 31, 32, and the outer ends of the iron supports are mounted on wheels 33 and 34, resp. which run against guide rails, marked with number 35 for the upper conveyor and number 36 for the lower one. Terminal controls 37 and 38 are also arranged for each conveyor. The motor driving the chains (not shown) is located outside the oven, and the movement of the two conveyors is synchronized by a synchronizing device (not shown), which is also located outside the hot zone of the oven.

In FIG. 3 the double arrow 39 intimates that the upper portion of the frame supporting the conveyor 10 is vertically adjustable. This feature, taken by itself, however forms no part of the invention, and the particular construction of this adjustment device is therefore not shown.

With the exception of the perforated plates 25, 26, the air distribution boxes from substantially closed constructions. To insure that an uniform air flow is obtained through a mat 40 located between the conveyor plates 29, 30, the air distribution boxes have been designed with decreasing cross sectional area towards the edge of the mat 40 remote from the induction port 21 and the evacuation port 22, resp.

In combination with this, the curing oven is also designed, so that the flow direction of the air through the mat 40 can be reversed. This is possible in that the pressure difference between an upper distribution box and a cooperating lower distribution box is adjustable by reversing the direction of action of that particular pump fan unit. These units are suitably driven, in such a way, that in one and the same oven section, the same pressure conditions prevail between the distribution boxes in the different groups of distribution boxes in the secton. Thus according to FIG. 2, the two connection boxes 19 could be so connected to the pump system so that a positive pressure is present between the upper and lower distribution boxes in the shown section. The distribution boxes in the adjacent section should be driven so that a negative pressure difference will occur, etc. It is of course also possible to have different pressure conditions between the distribution boxes in each group of distribution boxes in one and the same oven section.

In order to achieve satisfactory curing, it is however also of importance that the intended curing temperature is obtained. To make it possible to control the temperture precisely, it is therefore important that the heat leakage from the oven is negligible. Because of the high temperatures used, such a heat leakage also becomes annoying for persons in the environment of the oven.

In order to make the heat leakage from the curing oven negligible, the oven is completely encased and insulated. In addition thereto, the spaces of the oven located outside the air distribution boxes are kept at a lower pressure than the ambient pressure of the oven. This is achieved by means of evacuation pumps connected to the connection boxes 20, 20′, which evacuation pumps, through these connection boxes, communicate with the spaces surrounding the air distribution boxes connected to the hot air pump system through the connection boxes 19, 19′.

Figure 4:
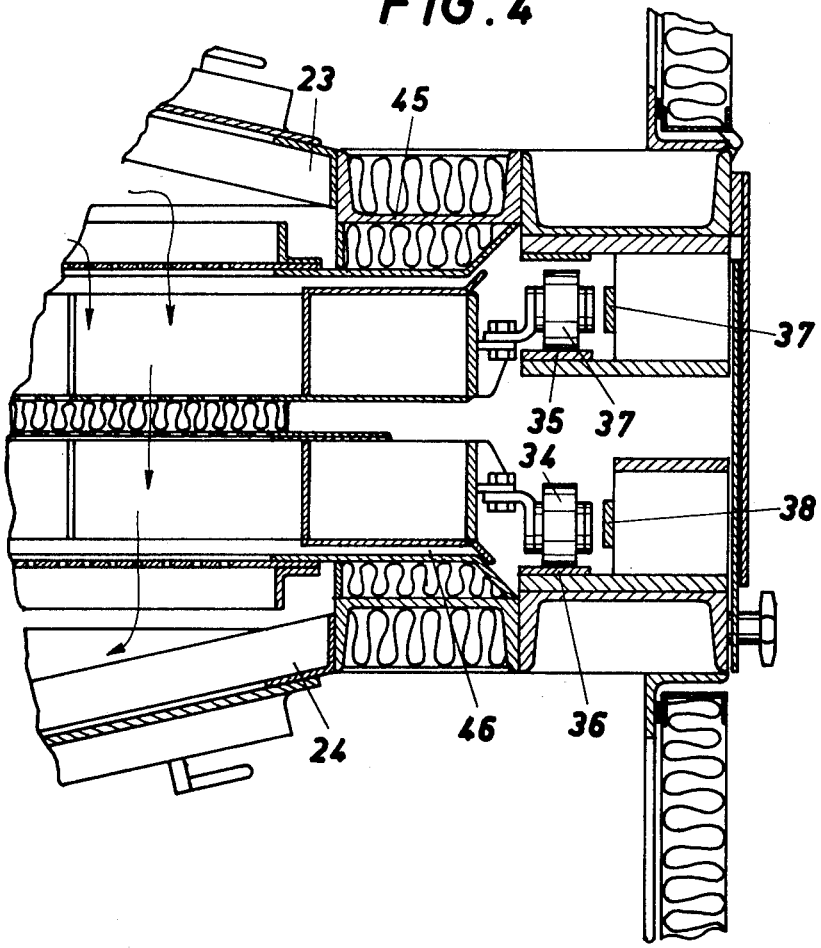
FIG. 4 shows a further enlarged view of the part of the oven marked with IV in FIG. 3.

As it appears from FIG. 4, measures have also been taken to minimize the heat leakage along the edges of the conveyor. Owing to this, the driving chains are also protected from unnecessary heating, and the lubrication problems decrease considerably. The oblique plate 23 of the upper distribution chamber terminates at the edge of the conveyor against an insulated girder construction 45. The lower limiting plate or wall 24 is correspondingly terminated against an insulated girder. The only heat emission to the environment, that can occur, is, therefore, the heat emission which is possible because of the flow through the space 46. Since this space is rather small, no considerable rise of temperature will occur along the conveyors.

To sum up, it can be stated that the invention provides a new curing oven in which an uniform aerodynamic air distribution is obtained along the whole mat width and length. The air can be brought in opposite directions, up-down, down-up through the mat. The heat leakage from the oven is minimized by maintaining a negative pressure, and the oven is furthermore insulated. Since a pressure supporting girder construction is used between the conveyor chains, the construction is so sealed, that there will be no hot air flow towards the conveyor chains, and these will be kept at a moderate temperature. The conveyor chains are led outside the hot zones, and in this way less wear and an efficient lubrication is achieved, besides which the energy consumption will be lower. It is also possible to blow cold air along the chains. Furthermore, the invention provides a curing oven with a greater capacity and a lower power consumption since a smaller quantity of hot gas is required in comparison with conventional curing ovens.

It is evident that variations and alternative embodiments of the above described curing oven are possible. Such modifications and alternate embodiments shall be within the scope of the claims.

What I claim is:

1. An oven for curing impregnated mineral wool mats, such as rock or glass wool as they pass through the oven comprising in combination:

an insulated housing;

a pair of endless conveyors defining a longitudinal path of travel through said insulated housing and having opposed confronting portions cooperating with opposite sides of the impregnated mineral wool mats to be maintained at an appropriate thickness as they are conveyed through the oven;

the oven including pressure-and-evacuation chamber means at opposite sides of the longitudinal path of travel of the conveyors and including means for directing a fluid treatment medium through the mat between the opposed confronting portions of the conveyors;

means for driving the conveyors through the insulated housing, said means for driving the conveyors being located outwardly of the pressure-and-evacuation means whereby the means for driving the conveyors are not generally subjected to curing temperatures immediately present in the chambers where the mineral wool is being cured, said oven including mutually-reversed separate chamber means communicating with said pressure-and-evacuation means for circulating the fluid treating medium through opposite sides of the mineral wool mats as they are cured, and means connected to the oven for maintaning interior areas of the housing, outside the pressure-and-evacuation chamber means, at a lower pressure than ambient pressure, said pressure-and-evacuation chamber means for directing the fluid treatment medium comprising a decreasing cross-sectional area transverse to the longitudinal direction of travel of the conveyors and in communication with induction and evacuation ports through which the fluid treatment medium is circulated.

2. The oven as claimed in claim 1, in which said pressure-and-evacuation chamber means comprises perforated air-distribution plates disposed above and below the respective conveyors.

3. The oven as claimed in claim 2, in which said conveyors include perforated plates comprising the confronting portions for contacting the mats being cured as they pass through the oven.

4. The oven as claimed in claim 1, in which said housing includes means for vertically adjusting the distance between the conveyors for accommodating different thickness of mineral wool mats.

5. The oven as claimed in claim 1, in which the housing includes guide portions outwardly of the pressure-and-evacuation chamber means and accommodating the drive means of the conveyors, said guide portions being substantially insulated away from said pressure-and-evacuation chambers.

6. The oven as claimed in claim 1, in which the oven comprises several adjacent sections each including pressure-and-evacuation chamber means, means for controlling the directions of flow of the treatment fluid medium in respective chambers for attaining different treatment condition in the sections.

* * * * *